US006249999B1

(12) United States Patent
Börge et al.

(10) Patent No.: US 6,249,999 B1
(45) Date of Patent: Jun. 26, 2001

(54) APPARATUS FOR TURNING OVER INDIVIDUAL BOARDS ASSEMBLED AS A STACK, PREFERABLY FOR LEAFING THE PROGRAM BOARDS OF A MUSIC BOX (JUKE BOX)

(75) Inventors: Heidersberger Börge; Menke Wilhelm, both of Rhein (DE)

(73) Assignee: NSM Aktiengesellschaft, Bingen/Rhein (DE)

( * ) Notice: Subject to any disclaimer, the term of this patent is extended or adjusted under 35 U.S.C. 154(b) by 0 days.

(21) Appl. No.: 09/010,610

(22) Filed: Jan. 22, 1998

(30) Foreign Application Priority Data

Jun. 26, 1997 (DE) ..... 297 11 177 U

(51) Int. Cl.[7] ..... G09F 19/00

(52) U.S. Cl. ..... 40/470; 40/476; 40/492; 40/508; 40/509; 40/531

(58) Field of Search ..... 40/470, 476, 492, 40/508, 509, 511, 531

(56) References Cited

U.S. PATENT DOCUMENTS 525,719 * 9/1894 Ray ..... 40/531
1,598,496 * 8/1926 Nickerson ..... 40/531
1,618,718 * 2/1927 Lees ..... 40/531
1,899,074 * 2/1933 Bascom ..... 40/531
5,031,346 * 7/1991 Herring et al. ..... 40/463
5,077,923 * 1/1992 Rockola et al. ..... 40/510
5,355,602 * 10/1994 Menke et al. ..... 40/476
5,704,146 * 1/1998 Herring et al. ..... 40/509

* cited by examiner

*Primary Examiner*—Anthony Knight
*Assistant Examiner*—Andrea Chop
(74) *Attorney, Agent, or Firm*—Dilworth & Barrese LLP.

(57) ABSTRACT

Apparatus for turning over individual boards assembled as a stack, preferably for leafing the program boards of a music box (juke box) is provided, in which boards may be rotated around mutually parallel pivot axes lying in a plane, pivoting bilaterally with the edge area of one side on mutually straight profile sections which can be moved synchronously in guides of a chassis by a drive in a straight line in both directions. The boards are provided with projections extending beyond the pivots, at which a stay fixed to the chassis engages in such a way that in each case, a diagonally supported board lying in a viewing window of the chassis is turned over to the opposite side, in which position it is supported at an approximately identical, mirror-image angle.

20 Claims, 8 Drawing Sheets

APPARATUS FOR TURNING OVER INDIVIDUAL BOARDS ASSEMBLED AS A STACK, PREFERABLY FOR LEAFING THE PROGRAM BOARDS OF A MUSIC BOX (JUKE BOX)

The invention relates to an apparatus for turning over individual boards assembled as a stack, preferably for leafing the program boards of a music box (juke box).

BACKGROUND OF THE INVENTION

In an apparatus of this type known from EP 0 441 949 B1, the individual program boards belonging to two stacks are pivoted next to each other in a chassis behind its two viewing windows around pivots located at their rear sides in such a way that they can be turned over individually by a rail movable to and fro by a drive which rail is provided with stops which engage at lug-shaped projections of the program boards extending beyond the pivots. Here, in each case two opened sides of each stack of the program boards become visible which sides lie diagonally on each side of each viewing window. According to the opened sides of the program boards assembled as racks in each case, the center migrates between two opened sides to the left or right in each viewing window because the pivots of the individual program boards are supported in a line next to each other fixed to the chassis and the row of pivots of each stack takes up a length corresponding to the breadth of the stack. Due to the migrating of the centerlines between the opened sides in the viewing windows, an unattractive appearance is created because the symmetry of the opened sides to the relevant viewing window is interrupted.

It is therefore the object of the invention to provide an apparatus of the type described above where the centerline between two opened program boards always remains at the same position in the center of the viewing window so that the two sides of the program boards always appear at the same place in the viewing window.

SUMMARY OF THE INVENTION

This object is solved in accordance with the invention by an apparatus for turning over individual boards assembled as a stack, preferably for leafing the program boards of a music box (juke box), which boards may be pivoted around mutually parallel pivot axes lying in a plane, pivoting bilaterally with the edge area of one side on mutually parallel straight profile sections which can be moved synchronously in guides of a chassis by a drive in a straight line in both directions, and are provided with projections extending beyond the pivots at which a stay fixed to the chassis engages in such a way that in each case a diagonally supported board lying in a viewing window of the chassis is turned over to the opposite side in which position it is supported at an approximately identical, mirror-image angle. In the apparatus in accordance with the invention, the centerline between two opened sides of the program boards always appears at the position in the viewing window at which the stay is located. The stay can therefore be aligned to the viewing window in such a way that the opened sides of the program boards always appear at the same position.

For this purpose, the profile sections are provided in a series of flush spindles pointing towards each other, the number of which corresponds to the number of boards. The individual program boards which appropriately consist of plastic injection moldings, thus only need to be provided with flush blind boreholes with which they can be pushed onto the flush spindles for their support.

For this purpose, the stay consists of a rod parallel to the flush spindles with each projection exhibiting flanks which are approximately at right angles to each other in accordance with the angle formed by the opened sides of the boards facing each other, with the rod entering over that flank lying in the direction of movement until it abuts the flank located at right angles to it and rotates it in the direction of movement while turning over the board. To have the centerline between two opened sides in the center of the viewing window, the rod appropriately lies in the vertical center plane of the viewing window.

One special problem when turning over stacks of program boards in such a way that always two opened sides appear in a viewing window, is to have to opened sides appearing at the same angle to each other. In accordance with a preferred embodiment, it is therefore provided that on at least one of the profile sections two toggle levers are supported in a rotatable manner around pivot axes parallel to the spindles which support themselves in each case with one leg on a guide curve fixed to the chassis and whose other legs support the outside board in each case of a side of the opened board stack, and that the guide curve is shaped in such way that the opened sides lying in the viewing field of the viewing window always form roughly the same angle of opening of preferably 90°.

In accordance with a further preferred embodiment, it is provided that the outer sides of the boards protrude in chambers with edges bent from their outsides parallel to the viewing window which always allow only one turning over of the boards visible in the viewing window. In this way, any unwanted turning over of the program boards by hand is prevented.

Appropriately, two leafable board stacks identically designed in mirror-image are positioned next to each other whose sides of the boards turned open are visible in windows lying next to each other and whose boards turned over towards each other extend into a common central chamber.

To allow the profile sections supporting the pivots of the boards to be moved synchronously, the upper and lower profile sections are appropriately connected by racks which mesh with pinions mounted on a common shaft supported in the chassis with a gear wheel of the gear driving the pinion via a controllable electric motor being provided with markings which can be scanned by a light barrier and which effect a stepped turning over. The light barrier emits signals corresponding to the marks scanned to an electronic control unit which then controls the electric motor in such a way that the program boards are turned over by steps or continuously in following steps.

Appropriately, the program boards possess compartments lying on both sides horizontally next to each other to store the title sheets of the content books and the title lists of the playable CD discs.

One special problem of the apparatus in accordance with the invention is that the stay engaging at the projections extending beyond the pivots of the program boards is not aligned to the program boards to be turned over so that a breakdown in turning may occur. In accordance with a further embodiment of the invention, it is therefore provided that the stay or the rod is guided in a movable manner in the chassis laterally to the straight profile sections against the force of a spring which attempts to move the rod in the direction of its engaged position at the projections extending beyond the pivots of the boards.

If, for example, external intervention is made in the moving title sheets or program boards by hand or by other means, it is possible with the sprung arrangement of the stay or the rod to prevent any jamming of the program boards by the fact that the stays or rods can give way backwards in a sprung manner. If the levers formed by the projections extending beyond the pivots possess at their ends stop surfaces formed by flanks roughly at right angles to each other for the stay or the rod, the rod can give way in a spring-like fashion when it moves over flanks of program boards not to be turned. Only when the rod abuts the flank of a program board to be turned over, is it held tensionally at the angle of engagement in its engagement position in which it effects the turning. Therefore, to be able to leaf a stack of program boards in a synchronized manner, it is only necessary to move the rod so far that it moves over the "incorrectly" lying program boards so that subsequently when the direction of movement of the profile sections supporting the program boards is reversed, the program boards can be turned in a coordinated and synchronised manner.

Appropriately, the rod is guided in longitudinal holes of the frame profile sections.

A flat spring can be provided moving the rod in the direction of its engagement position.

To adjust the leafing mechanism, for example after a change of the program board stack or after replacing individual program boards, it may be necessary to be able to freely move the profile sections supporting the program boards in their guides. However, this is not possible if the profile sections are coupled with the drive. In accordance with another preferred embodiment, it is therefore provided that a coupling is provided by means of which the shaft supporting the pinions can be separated from its drive.

As the coupling, a stepped gear consisting of two gear wheels connected to each other can be provided on one axle which stepped gear is supported axially in a movable manner against the force of a spring, from which gear one gear wheel meshes with a gear wheel driven by the electric motor and the other gear wheel meshes with a gear wheel driving the pinion shaft with the stepped gear being disengaged from at least the driving or driven gear wheel by an axial movement and with the spring attempting to maintain the stepped gear in engagement with the driving and driven gear wheels.

In order to engage and disengage the coupling, a pull or push strap can be provided with which the stepped gear can be disengaged from the driven and/or driving gear wheel.

BRIEF DESCRIPTION OF THE DRAWINGS

One embodiment of the invention is described below in detail by means of the drawing which shows in FIG. 1 a perspective view of the chassis accepting the board stack with the apparatus for turning over the individual boards of the stack from which the board stacks have been removed for reasons of a better overview.

DESCRIPTION OF THE PREFERRED EMBODIMENTS

Figure 1:
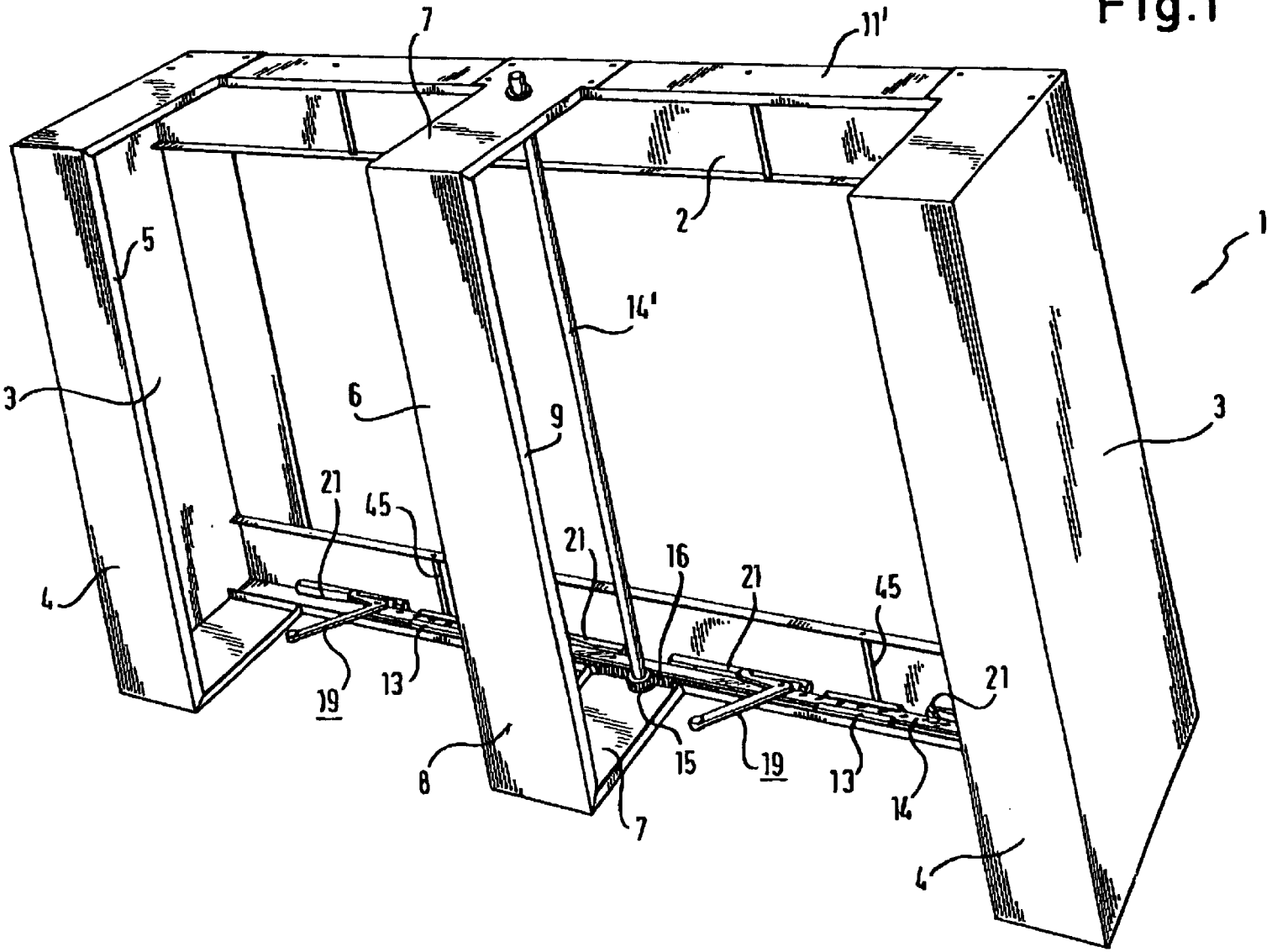
Figure 2:
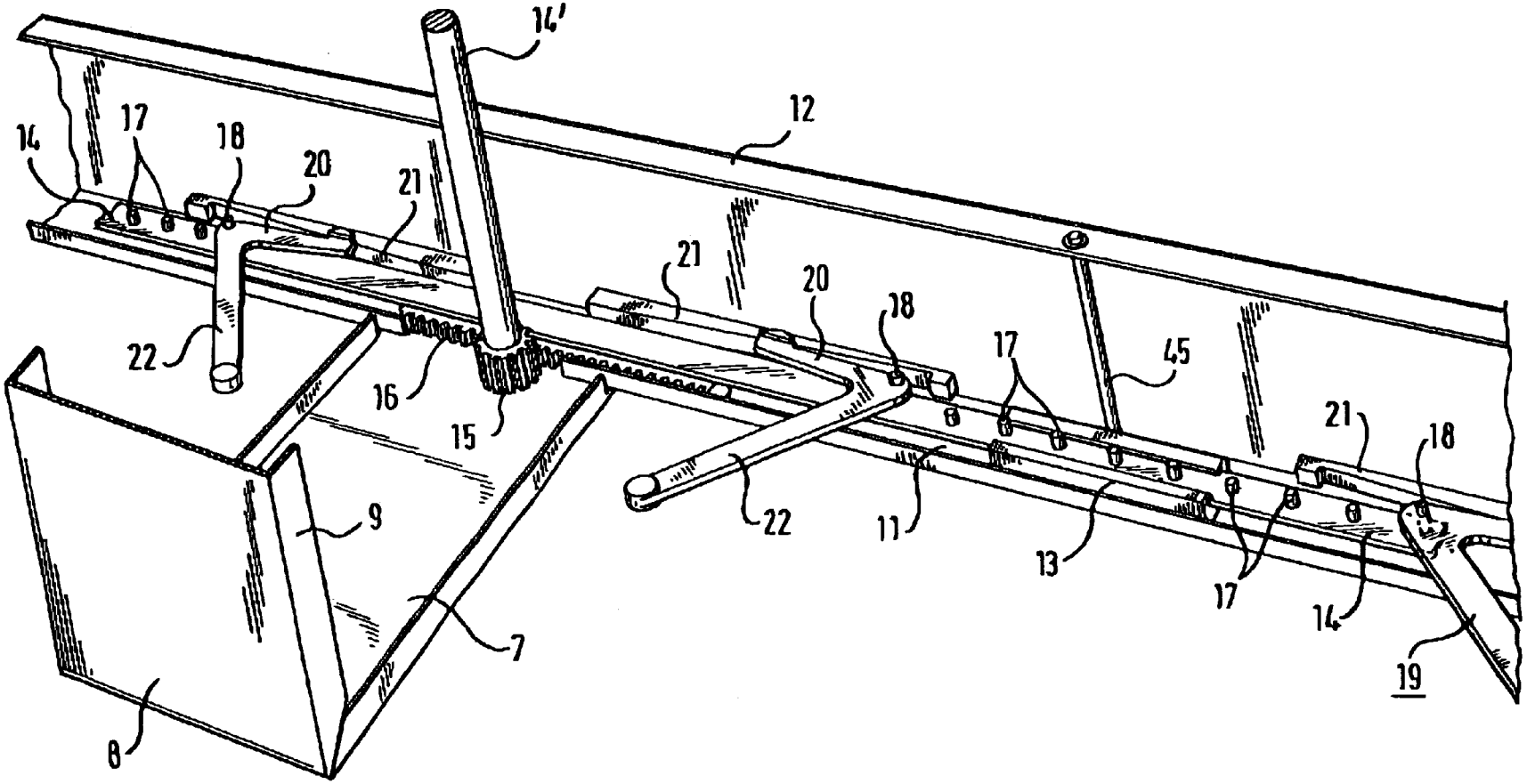
FIG. 2 a perspective view of the central lower chassis part from FIG. 1 in an enlarged view.
Figure 3:
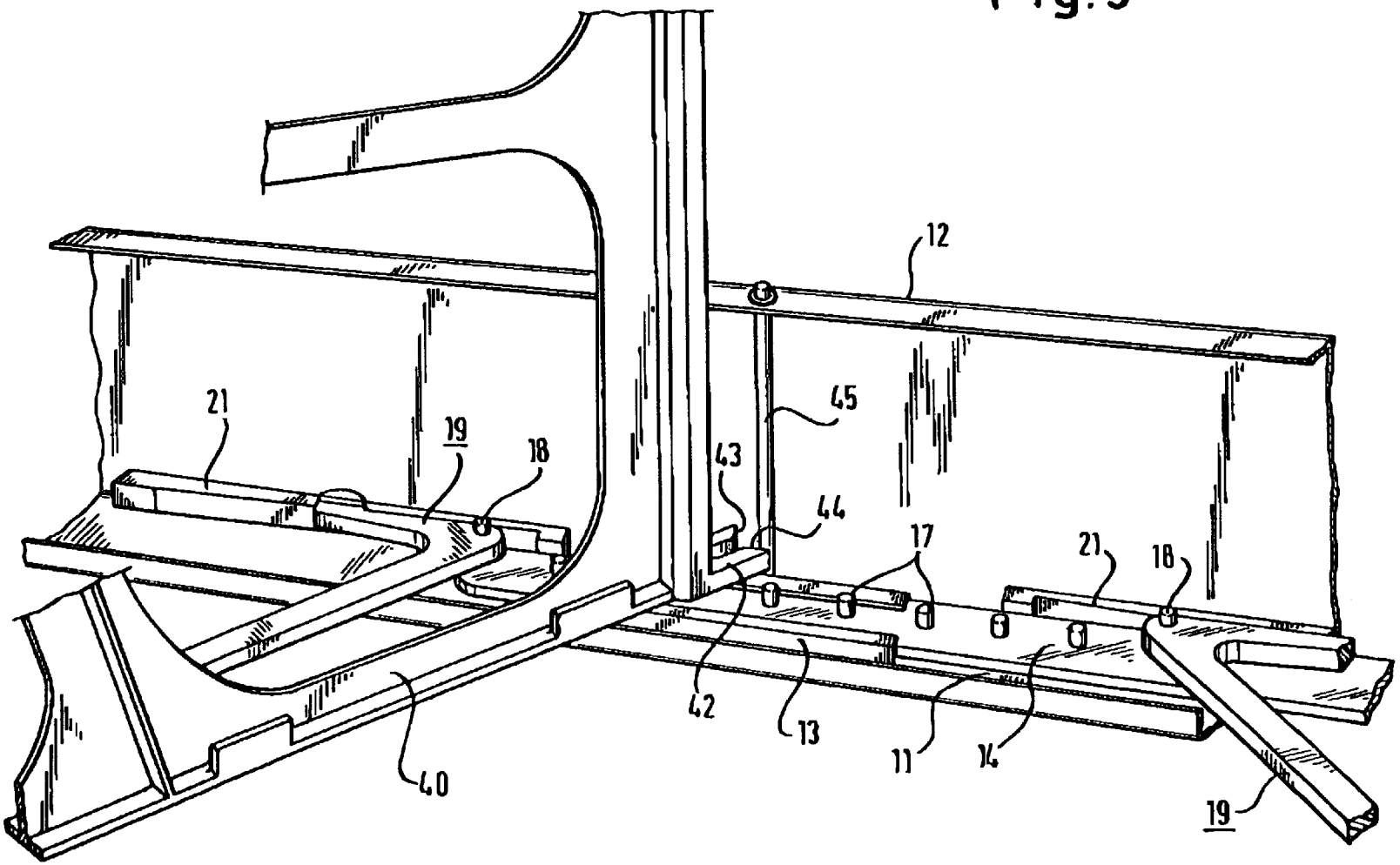
FIG. 3 a perspective view of the lower rail supporting the programme boards with an inserted program board in an enlarged view FIG. 4 a view in accordance with FIG. 3 of the left part of the profile rail from FIG. 3 without the inserted program board.
Figure 4:
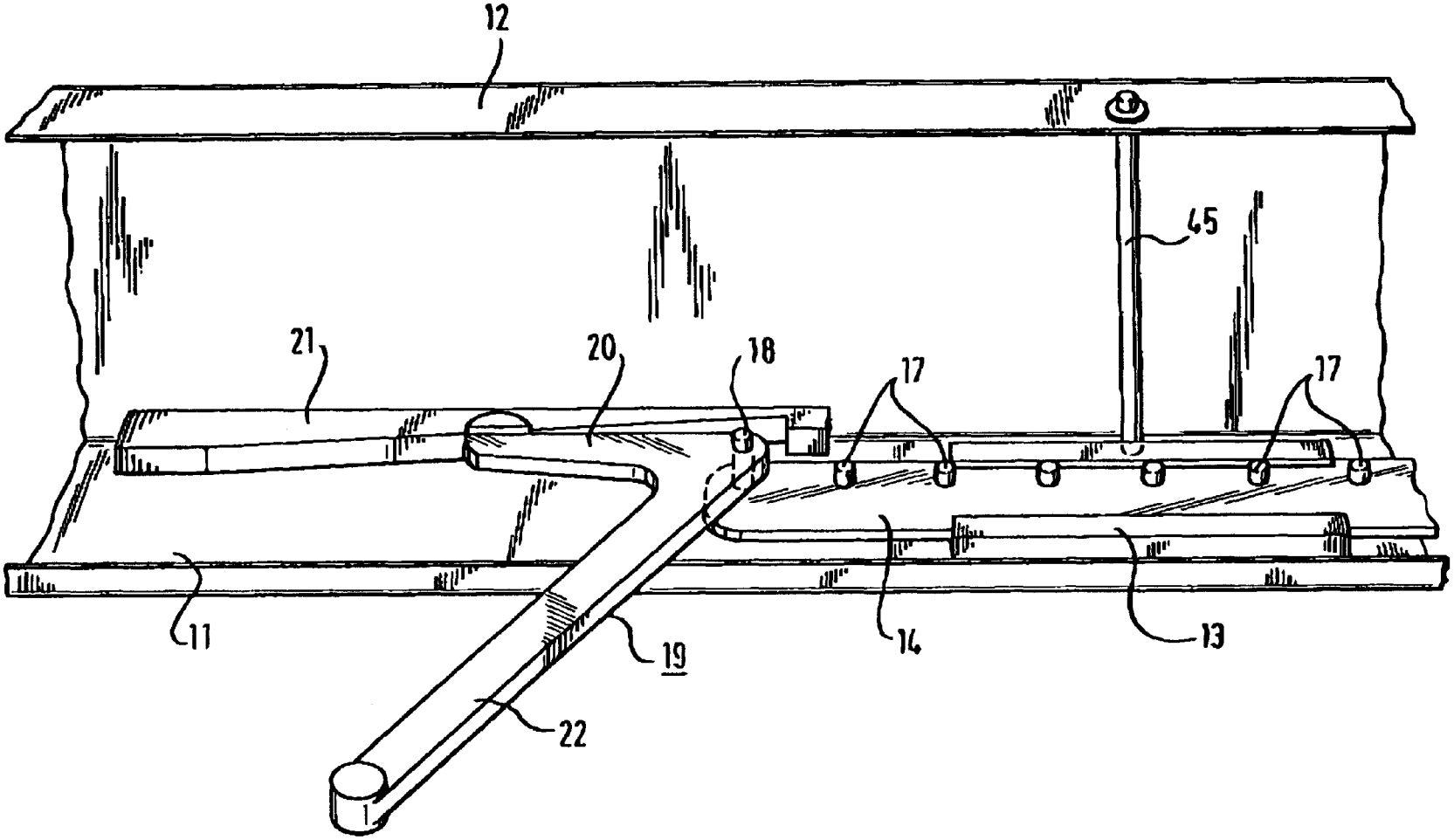

The program display shown in FIG. 1 for music boxes (juke boxes) consists of a chassis 1 which can be manufactured from blanked sheet metal components or as a plastic injection molding. Rectangular chambers 3 which are open towards the middle are connected to the narrow faces of a rear frame 2 consisting of mutually parallel profile sections. Rectangular edge rails 5 are bent towards the frame 2 from the front side walls 4, which are parallel to the frame 2, of the chambers 3. Arranged in the middle between the end chambers 3 is a channel-section web 6, the legs 7 of which are connected to the angled side edges of the profile sections forming the long sides of the frame 2. The front end of the channel-section web 6 lies in a plane with the front ends 4 of the chambers 3. The outer faces of the legs 7 of the channel-section web 6 lie in a plane with the top and bottom faces of the end chambers 3. Edge strips 9 are inwardly bent at right angles from the rectangular front end 8 of the channel-section web 6.

Secured in an inwardly angled edge strip 11 of the lower long profile section 12 of the frame 2 are guide rails 13 with a C-section profile open at the top, in which guide rails 13 is guided a longitudinally sliding rectangular profile section 14.

A freely rotational shaft 14' is pivot-mounted in the legs 7 of the channel-section web element close to the lower frame profile section 12. Said shaft 14' features at its top and bottom ends pinions 15 which mesh with a rack 16 riveted to rectangular section rail 14.

The rectangular section rail 14 features pins 17 at its ends, which form the spindles for mounting the program boards. Also mounted in the upper, angled profile section 11' are guide pieces 13, in which is mounted, in an arrangement mirroring that of the lower profile section 14, an identical profile section with flush-aligned bearing pins which serves to retain the top end of the suspended program boards, The upper profile rail is also riveted to a rack which meshes with the upper pinion of the shaft 14'.

To the side of each of the two rows of spindles 17 are mounted on spindles 18 angled levers 19, of which the shorter arms 20 are located so that they slide on a guide cam arrangement 21 fixed to the frame. The longer arms 22 form support levers for the outer program boards of the opened stack.

Secured to the bottom of the upper leg 7 of the channel-section web element 6 is a controllable electric motor 30 which drives, via a worm 31, a worm gear 33, this being connected coaxially to a gear wheel 32 which meshes with gear wheel 34. Gear wheel 34 is rotationally fixed to shaft 14'. The pinions 15 mounted on shaft 14' mesh, in the manner described, with the racks 16 which are riveted to the rectangular profile section 14. The gear wheel 34 is provided with three markings 35, which are concentric to its rotational axis and of equidistant angular displacement, these being scanned by a photoelectric element 36 which transmits its signals for controlling the motor 30 to an electronic control not illustrated.

The program boards 40 comprise fame-like, essentially rectangular injection moldings which are provided at the inner ends of their short sides with blind holes 41, these being flush with one another with their centerline running through the rear long edge profile section of the program board. The program boards 40 are mounted with these blind holes 41 on the pins 17 of the rail 14 sliding in the guide pieces 13, so as to provide for their pivot mounting.

In an extension of their upper and lower narrow edge profile sections, the program boards 40 are provided with projections which, emanating from a central notch, exhibit flanks 43, 44 arranged at right angles to each other. In the center plane of the window formed between the lateral chambers 4 and the center channel-shaped web element 6 are secured between the inwardly angled edges of the long side profile sections of frame 2, rods 45 which serve as stays to enable the program boards to be turned or "leafed through". As the rectangular profile rail 14 moves, the rods of each window side slide over one of the flanks 43, 44 of the projections 42 into the angled recesses between these until they abut the right-angled flank 43 or 44, so effecting the turning over of the program board. The outer sides of the program cards 40 protrude into the side chambers 3 with the outer sides of the program boards being overlapped by the bent edge strips 5 of the chambers. The bent edge strips 5 allow the turning over of the program cards whose sides are visible in the windows, but prevent any turning over of the following program cards in the manner visible from FIG. 5.

Figure 5:
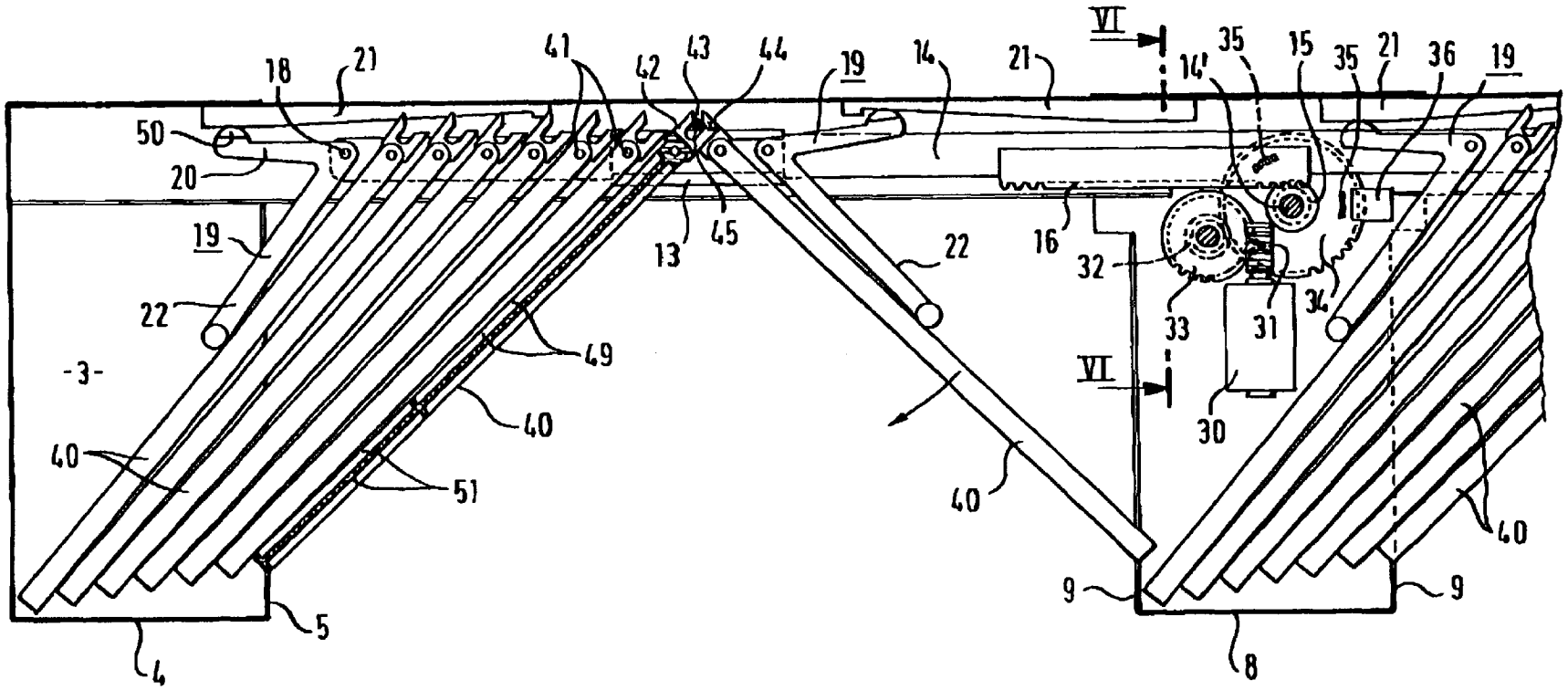
FIG. 5 a horizontal section through the chassis from FIG. 1.

As can be seen from FIG. 5, the program cards 40 pivoted on the pins 17 on the rail 14 possess on their side serving their support a greater distance to each other than that corresponding to their thickness. The outer sides of the program cards 40, however, abut each other in the chambers 3 so that the program card stack is wider on the support side than on the outer side. To ensure that the program boards always appear at the same oblique angle in the viewing windows, the legs 22 of the toggle levers 19 always press each side of the opened stack together in such a way that the outer sides of the program boards abut each other. This is achieved by the legs 20 of the toggle levers 19 being provided at their ends with slide pieces 50 which slide on the guide curve 21 whose gradient decreases inwardly in the manner visible from FIG. 5 in such a way that the lever 22 gives way outwardly as the stack height decreases.

The central channel web-section part 6 forms a chamber open to both sides in which the program boards turned over to the center of both program stacks lie. The central chamber formed in this way can take up the program boards turned over to the center of both program stacks because as the profile rod 14 is moved to the left or right the same number of program boards is turned into the central chamber which is turned out of it again.

Figure 6:
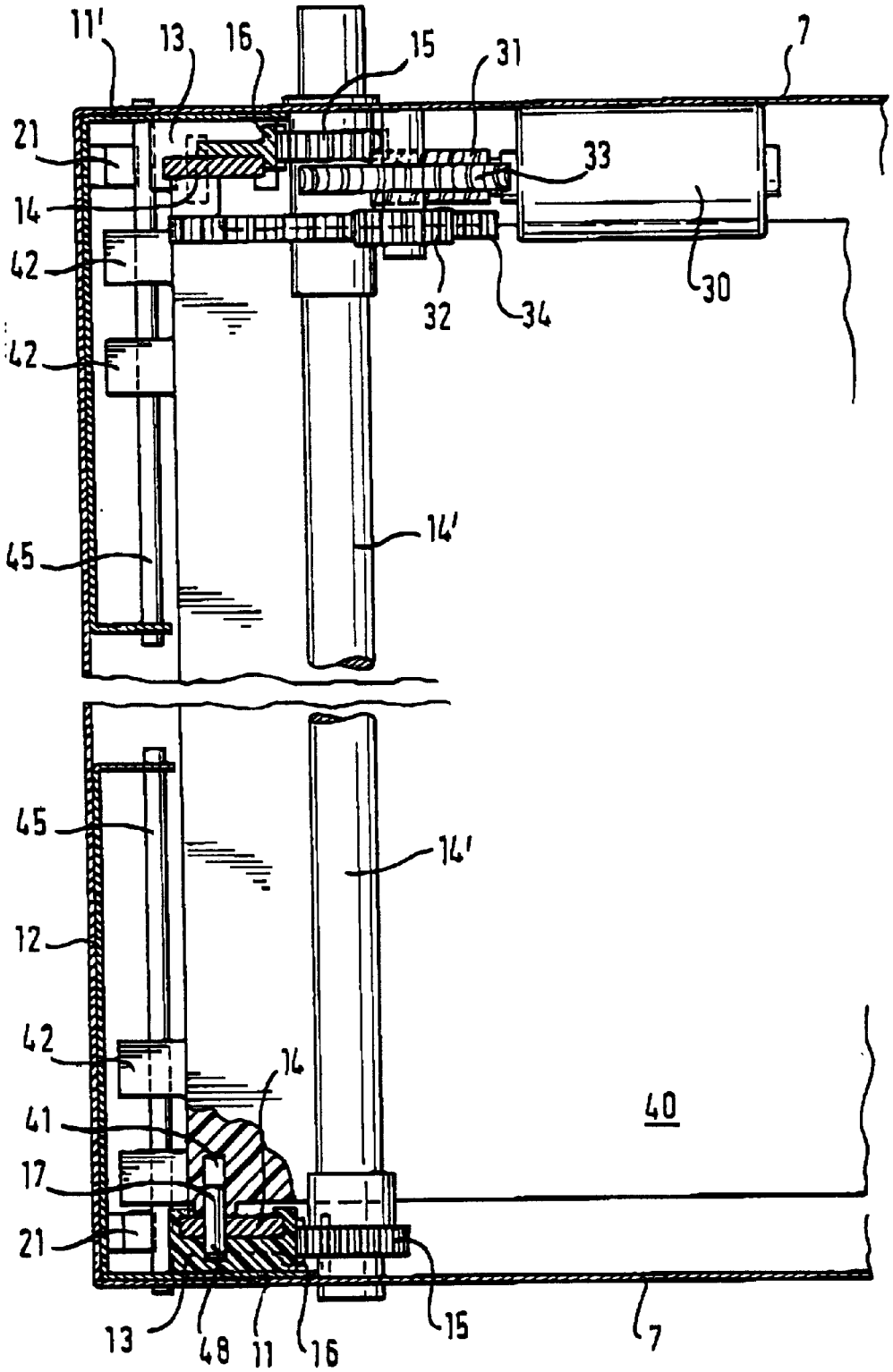
FIG. 6 a section through the chassis along the line VI—VI in FIG. 5.

To reduce the friction of the movable profile rail in the guide parts 13, the pins 17 penetrate the profile rail in the manner visible from FIG. 6 so that these slide on the base of the C-shaped groove of the guide pieces 13 with their lower rounded heads 48.

The program boards 40 are provided on both sides in rows arranged above each other with compartments 50 to insert the content books of the CD disks and with compartments 51 to insert the title cards.

Figure 7:
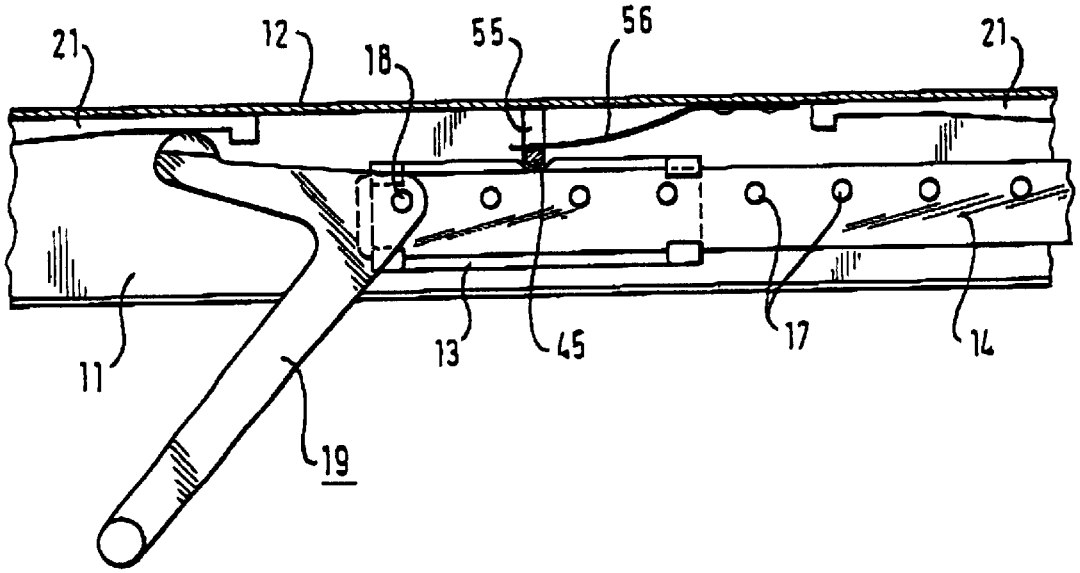
FIG. 7 a top view of the lower frame profile section with the rod guided in a movable manner in a longitudinal hole.
Figure 8:
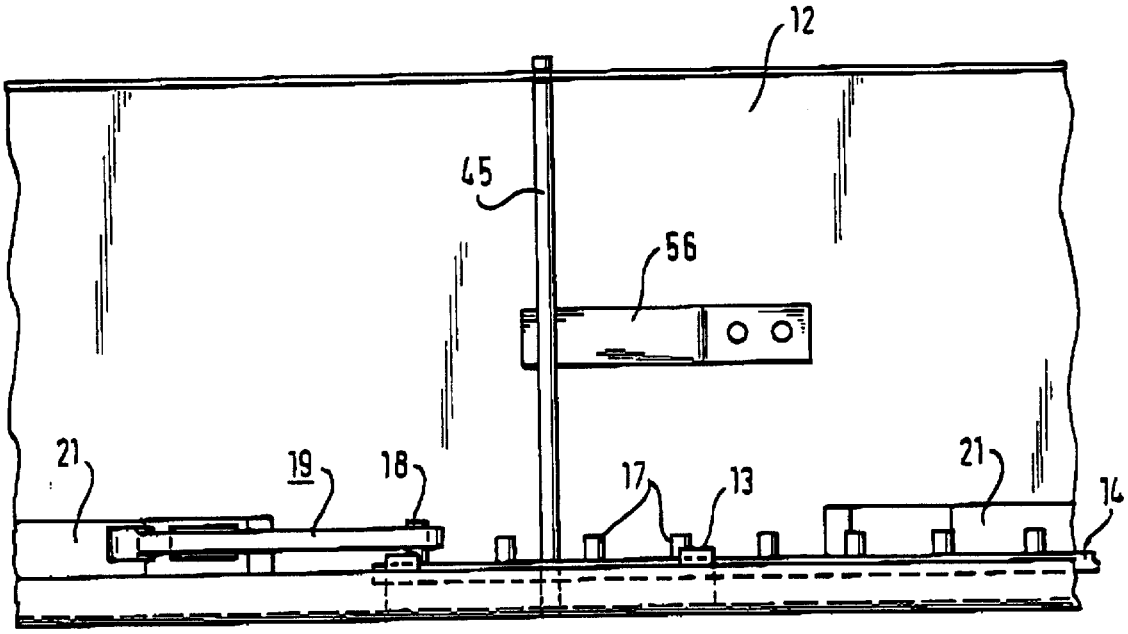
FIG. 8 a rear view of the frame profile section with the rod guided in a movable manner in it.

As can be seen from FIGS. 7 and 8, the rod 45 forming a stay can be guided movably in longitudinal holes 55 of the edge strips 11 bent from the frame profile section 12 which runs laterally to the profile rail 14. One end of a biased flat spring 56 is riveted to the frame profile 12 and the spring attempts to maintain the rod 45 in its engagement position visible from FIG. 8 at the ends of the longitudinal holes 55 facing the profile rails 14.

Figure 9:
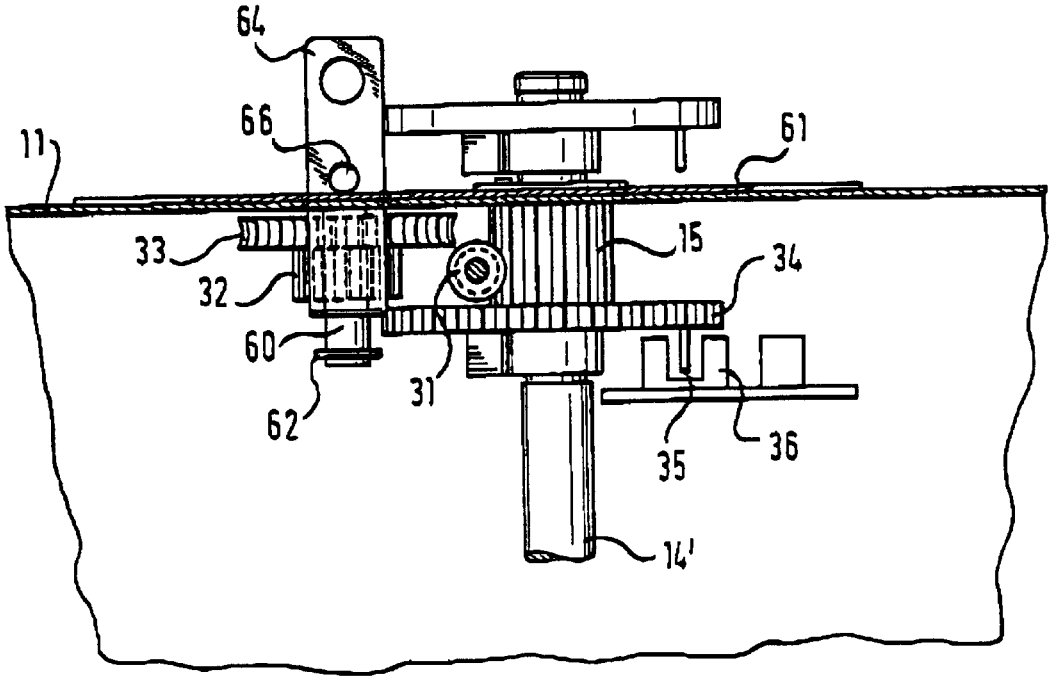
FIG. 9 a rear view of the upper frame profile section with the drive for the pinion shaft arranged on it.
Figure 10:
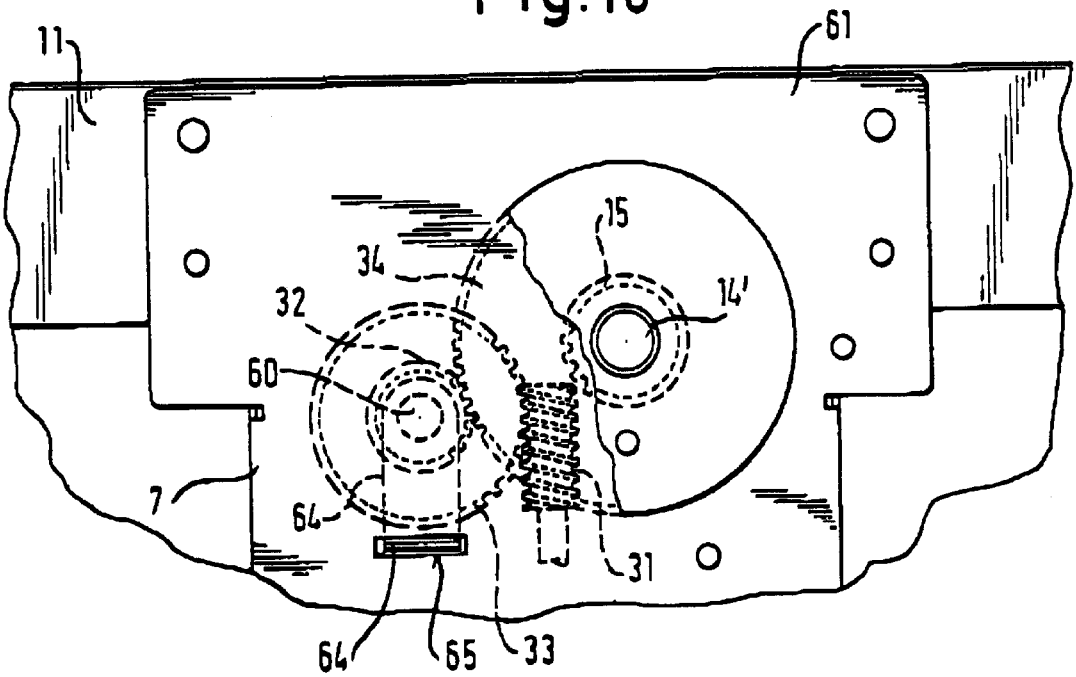
FIG. 10 a top view of the arrangement from FIG. 10.

For the rod 45, guides are provided so that it is held in the longitudinal holes 55 in only a laterally movable manner, but cannot be moved in an axial direction. As can be seen from FIGS. 9 and 10, the stepped gear is guided in an axially movable manner with the worm gear 33 and the gear wheel 33 positioned coaxially and next to each other on an axle 60 which is connected at the edge strip 11 or at the connection sheet 61 connected to it of the upper leg 7 of the channel-section web. In the drive position, the stepped gear is held in abutment with a ring 62 which is located at the lower free end of the axle 60. In this drive position of the stepped gear, the worm gear 33 meshes with the worm 31 and the gear wheel 32 with the gear wheel 34 wedged in a non-turning manner on the shaft 14'. The stepped gear 32, 33 is held in abutment to the lower ring 62 by a spring not shown.

The ring 62 is connected to an angled actuation piece 64 whose leg bent off the ring section 62 protrudes upwards through a slot 65 of the leg 7. By pulling on the leg of the actuating piece 64 passing through the slot 65, the stepped gear 32, 33 can be moved upwards so that the worm gear 33 and the gear wheel 32 are disengaged from the worm 31 and the gear wheel 34. This uncoupled position can be fixed by having a borehole 66 provided in the leg of the actuating piece 64 passing through the slot 65 through which borehole a pin, for example a screwdriver, can be pushed through to fix in position. If the leg of the angled actuating piece 64 passing through the slot 65 is released, the spring not shown presses the stepped gear back into a position where the drive is coupled with the pinion shaft 14'.

What is claimed is:

1. Combination of an apparatus for rotating individual boards assembled as a stack and boards (40), said apparatus comprising mutually parallel pivot axes (17) lying in a plane upon which the boards may be individually rotated for pivoting bilaterally with an edge area on mutually parallel straight profile sections (14) which are arranged to move synchronously in guides (13) of a chassis (1) by a drive (30–34, 14', 15, 16) in a straight line in both directions, and projections (42) being provided on the individual boards extending beyond the pivot axes, at which a stay (45) fixed to the chassis engages in such a way that a board (40) being diagonally supported and lying in a viewing window of the chassis (1) is rotated to an opposite side, in which position the board is supported at an approximately identical, mirror-image angle, two adjacent boards, one being diagonally supported, and the other being supported at the approximately identical, mirror-image angle defining an opened position of the two adjacent boards, and said apparatus structured and arranged such that a center line between two adjacent boards in said opened position, always remains at the same position in a center of the viewing window such that two sides of the boards always appear at the same location in the viewing window.

2. Combination according to claim 1, wherein the pivot axes are defined by a series of flush spindles (17) pointing towards each other on the profile sections (14), the number of which corresponds to the number of boards (40).

3. Combination according to claim 2, wherein the stay is constituted by a rod (45) which lies in a vertical central plane of the viewing window.

4. Combination according to claim 1, wherein the stay is constituted by a rod (45) which lies in a vertical central plane of the viewing window.

5. Combination according to claim 1 structured and arranged to have two board stacks and two viewing windows lying next to each other, said board stacks identically designed in mirror-image are positioned next to each other such that sides of two adjacent boards of each stack, in said opened position are visible in said respective viewing windows and structured and arranged such that boards of each stack which are rotated towards each other, extend in a common central chamber (8, 9).

6. Combination according to claim 1, wherein the profile sections (14) are connected by racks (13) which mesh with pinions (15) mounted on a common shaft (14') supported in the chassis (1) and an electric motor is provided which drives the shaft (14').

7. Combination according to claim 6, wherein a gear wheel (34) of a gear driving the pinions (15) via a controllable electric motor is provided with a marking (35) which can be scanned by a light barrier (36) and which effects a stepped turning over of the boards (40).

8. Combination according to claim 6, wherein a coupling is provided by means of which the shaft (14') supporting the pinions (15) can be released from its drive.

9. Combination according to claim 8, wherein a stepped gear on one axle constituted by two gear wheels (32, 33) connected to each other (60) is supported axially in a movable manner against force of a spring, from which gear one gear wheel (33) meshes with a gear wheel driven by at least one of an electric motor and a worm (31) and the other meshes with a gear wheel (34) driving the pinion shaft (14'), the stepped gear is disengaged from at least the driving or driven gear wheel by an axial movement and the spring biases to maintain the stepped gear in engagement with the driving and driven gear wheels.

10. Combination according to claim 9, wherein one of a pull strap (64) and a push strap is provided with which the stepped gear can be disengaged from the driven or driving gear wheels.

11. Combination according to claim 1, structured and arranged to support the boards (40) such that compartments (50, 51) are provided on the boards to lie on opposite sides of each board horizontally next to each other to store title sheets of content books and title lists of playable compact discs.

12. Combination according to claim 1, wherein the stay (45) is guided in a movable manner in the chassis laterally to the straight profile sections (14) against the force of a spring (56) which biases to move the stay (45) in the direction of an engaged position with the projections extending beyond the pivot axes of the boards.

13. Combination according to claim 12 wherein the stay (45) is guided in longitudinal holes (55) of frame profile sections (11, 12).

14. Combination according to claim 12, wherein said spring (56) is a flat spring.

15. Combination of an apparatus for rotating individual boards assembled as a stack and the boards (40), said apparatus comprising mutually parallel pivot axes (17) lying in a plane upon which the boards may be individually rotated for pivoting bilaterally with an edge area on mutually parallel straight profile sections (14) which are arranged to move synchronously in guides (13) of a chassis (1) by a drive (30–34, 14', 15, 16) in a straight line in both directions, and projections (42) being provided on the individual boards extending beyond the pivot axes, at which a stay (45) fixed to the chassis engages in such a way that a board (40) being diagonally supported and lying in a viewing window of the chassis (1) is rotated to an opposite side in which position the board is supported at an approximately identical, mirror-image angle, two adjacent boards, one being diagonally supported, and the other being supported at the approximately identical, mirror-image angle defining an opened position of the two adjacent boards, wherein the stay is constituted by a rod (45) parallel to said pivot axes (17) and each projection (42) exhibits flanks (43, 44) which are approximately at right angles to each other in accordance with an angle formed by open sides of two adjacent boards in said open position, with the rod (45) structured and arranged to enter over a said one of said flanks lying in a direction of movement until the rod (45) abuts another of said flanks located at right angles to said one of said flanks and rotates said another of said flanks in the direction of movement while rotating the board.

16. Combination according to claim 15, wherein the rod (45) lies in a vertical central plane of the viewing window.

17. Combination of an apparatus for rotating individual boards assembled as a stack and the boards (40), said apparatus comprising mutually parallel first pivot axes (17) lying in a plane upon which the boards may be individually rotated for pivoting bilaterally with an edge area on mutually parallel straight profile sections (14) which are arranged to move synchronously in guides (13) of a chassis (1) by a drive (30–34, 14', 15, 16) in a straight line in both directions, and projections (42) being provided on the individual boards extending beyond the first pivot axes, at which a stay (45) fixed to the chassis (1) engages in such a way that a board (40) being diagonally supported and lying in a viewing window of the chassis (1) is rotated to an opposite side in which position the board is supported at an approximately identical, mirror-image angle, two adjacent boards, one being diagonally supported, and the other being supported at the approximately identical, mirror-image angle defining an opened position of the two adjacent boards, wherein upon at least one of the profile sections (14) two toggle levers (19) are supported in a rotatable manner around second pivot axes (18) parallel to the first pivot axes (17) and which are supported with one leg (20) on guide curves (21) fixed to the chassis and whose other legs (22) are arranged to support an outside board of a side of a board stack which is in said opened position and each of said guide curves (21) is shaped in such a way that sides of boards (40) in said opened position and lying in a viewing field of the viewing window always form roughly the same angle of opening.

18. Combination according to claim 17, wherein said angle of opening is approximately 90°.

19. Combination of an apparatus for rotating individual boards assembled as a stack and the boards (40), said apparatus comprising mutually parallel pivot axes (17) lying in a plane upon which the boards may be individually rotated for pivoting bilaterally with an edge area on mutually parallel straight profile sections (14) which are arranged to move synchronously in guides (13) of a chassis (1) by a drive (30–34, 14', 15, 16) in a straight line in both directions, and projections (42) being provided on the individual boards extending beyond the pivots, at which a stay (45) fixed to the chassis (1) engages in such a way that a board (40) being diagonally supported and lying in a viewing window of the chassis (1) is rotated to an opposite side in which position the board is supported at an approximately identical, mirror-image angle, said apparatus structured and arranged to support the boards such that outer sides of the boards (40) protrude in chambers (3, 8, 9) with edges (5, 9) bent from outside parallel to the viewing window and which edges only allow a rotation of the boards (40) visible in the viewing window.

20. Combination of an apparatus for rotating individual boards assembled as a stack and the boards (40), said apparatus comprising mutually parallel pivot axes (17) lying in a plane upon which the boards may be individually rotated for pivoting bilaterally with an edge area on mutually parallel straight profile sections (14) which are arranged to move synchronously in guides (13) of a chassis (1) by a drive (30–34, 14', 15, 16) in a straight line in both directions, and projections (42) being provided on the individual boards extending beyond the pivot axes, at which a stay (45) fixed to the chassis engages in such a way that a board (40) being diagonally supported and lying in a viewing window of the chassis (1) is rotated to an opposite side, in which position the board is supported at an approximately identical, mirror-image angle, wherein the pivot axes are defined by a series of flush spindles (17) pointing towards each other on the profile sections (14), the number of which corresponds to the number of boards (40), and the stay is constituted by a rod (45) parallel to the flush spindles (17) and each projection (42) exhibits flanks (43, 44) which are approximately at right angles to each other in accordance with an angle formed by open sides of the boards (40) facing each other, with the rod (45) structured and arranged to enter over a said one of said flanks lying in a direction of movement until the rod (45) abuts another of said flanks located at right angles to said one of said flanks and rotates said another of said flanks in the direction of movement while turning over the board.

* * * * *

UNITED STATES PATENT AND TRADEMARK OFFICE

CERTIFICATE OF CORRECTION

PATENT NO. : 6,249,999 B1
DATED : June 26, 2001
INVENTOR(S) : Borge Heidersberger and Wilhelm Menke It is certified that error appears in the above-identified patent and that said Letters Patent is hereby corrected as shown below:

Title page,
Item [75], Inventors, which reads:
"Heidersberger Börge; Menke Wilhelm, both of Rhein (DE)" should read:
-- Börge Heidersberger; Wilhelm Menke, both of Bingen/Rhein (DE) --

Signed and Sealed this

Thirteenth Day of August, 2002

*Attest:*

*Attesting Officer*

JAMES E. ROGAN
*Director of the United States Patent and Trademark Office*